US007484551B2

(12) United States Patent
Blejde et al.

(10) Patent No.: US 7,484,551 B2
(45) **Date of Patent: *Feb. 3, 2009**

(54) CASTING STEEL STRIP

(75) Inventors: Walter Blejde, Brownsburg, IN (US); Rama Ballav Mahapatra, Brighton-le-Sands (AU); David Sosinsky, Carmel, IN (US); Mark Schlichting, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/548,493

(22) Filed: Oct. 11, 2006

(65) Prior Publication Data

US 2007/0114002 A1 May 24, 2007

Related U.S. Application Data

(63) Continuation of application No. 10/961,300, filed on Oct. 8, 2004, now Pat. No. 7,156,151.

(60) Provisional application No. 60/510,479, filed on Oct. 10, 2003.

(51) Int. Cl.
*B22D 11/00* (2006.01)
*B22D 11/06* (2006.01)

(52) U.S. Cl. ..... 164/480; 164/459

(58) Field of Classification Search ..... 164/428, 164/459, 480

See application file for complete search history.

(56) References Cited

U.S. PATENT DOCUMENTS

| | | | |
|---|---|---|---|
| 3,670,400 | A | 6/1972 | Singer |
| 4,006,044 | A | 2/1977 | Oya et al. |
| 5,103,895 | A | 4/1992 | Furuya et al. |
| 5,106,412 | A | 4/1992 | Bogan et al. |
| 5,180,450 | A | 1/1993 | Rao |
| 5,320,687 | A | 6/1994 | Kipphut et al. |
| 5,720,336 | A | 2/1998 | Strezov |
| 5,760,336 | A | 6/1998 | Wang |

(Continued)

FOREIGN PATENT DOCUMENTS

| | | |
|---|---|---|
| EP | 0 922 511 A1 | 6/1999 |

(Continued)

OTHER PUBLICATIONS

Sosinsky, D. J., et al., "Determination and Prediction of Water Vapor Solubilities in CaO-MgO-SiO2 Slags", Mar. 1985, Metallurgical Transactions B, vol. 168, pp. 61-66.

(Continued)

*Primary Examiner*—Kuang Lin
(74) *Attorney, Agent, or Firm*—Hahn Loeser & Parks, LLP

(57) ABSTRACT

A method of controlling heat flux between the casting pool and the surfaces of the casting roll in a strip steel casting process includes controlling the concentration of nitrogen in the steel melt. The concentration of nitrogen may be controlled to achieve an operational heat transfer to the casting roll. The beat flux to the casting rolls may be controlled by maintaining the sum of partial pressures calculated from the nitrogen and hydrogen concentrations in the casting pool below 1.15 atmospheres. Decreasing the concentration of nitrogen can increase heat flux at the casting rolls.

35 Claims, 6 Drawing Sheets

U.S. PATENT DOCUMENTS

| | | | | |
|---|---|---|---|---|
| 5,787,967 | A | 8/1998 | Vendeville et al. | |
| 5,820,817 | A | 10/1998 | Angeliu et al. | |
| 5,906,791 | A | 5/1999 | Angeliu | |
| 5,934,359 | A | 8/1999 | Strezov | |
| 6,059,014 | A | 5/2000 | Strezov | |
| 6,290,787 | B1 | 9/2001 | Babbit et al. | |
| 6,328,826 | B1 | 12/2001 | Iung et al. | |
| 6,372,057 | B1 | 4/2002 | Fujimura | |
| 6,478,899 | B1 | 11/2002 | Legrand et al. | |
| 6,588,494 | B1 | 7/2003 | Mazurier et al. | |
| 6,622,779 | B1 * | 9/2003 | Mazurier | 164/480 |
| 6,808,550 | B2 | 10/2004 | Mahapatra et al. | |
| 7,156,151 | B2 * | 1/2007 | Mahapatra et al. | 164/480 |
| 2003/0116301 | A1 | 6/2003 | Blejde et al. | |
| 2004/0177945 | A1 | 9/2004 | Blejde et al. | |

FOREIGN PATENT DOCUMENTS

| | | | |
|---|---|---|---|
| JP | 52-139622 | A | 11/1977 |
| JP | 58-45321 | A | 3/1983 |
| JP | 64-83339 | A | 3/1989 |
| JP | 4-279246 | A | 10/1992 |
| JP | 11-179489 | A | 7/1999 |
| JP | 2001-220642 | A | 8/2001 |
| JP | 2002-361372 | A | 12/2002 |
| JP | 2003-154441 | A | 5/2003 |
| WO | 00/07753 | A1 | 2/0000 |
| WO | 98/28452 | A1 | 7/1998 |
| WO | 2005/035169 | | 4/2005 |

OTHER PUBLICATIONS

Zasowski, Peter J., et al., "Control of Heat Removal in the Continuous Casting Mould", 1990 Steelmaking Conference Proceedings, pp. 253-259.

PCT/AU2007/001548 International Search Report.

PCT/AU2007/001548 Written Opinion.

* cited by examiner

CASTING STEEL STRIP

RELATED APPLICATION

This application is a continuation in part that claims priority to and the benefit of U.S. patent application Ser. No. 10/961,300 filed Oct. 8, 2004, now U.S. Pat. No. 7,156,151, and U.S. provisional patent application 60/510,479 filed Oct. 10, 2003, both of which are incorporated herein by reference.

BACKGROUND AND SUMMARY OF INVENTION

This invention relates to the casting of steel strip. It has particular application for continuous casting of thin steel strip less than 5 mm in thickness in a roll caster.

In a roll caster, molten metal is cooled on casting surfaces of at least one casting roll and formed into thin cast strip. In roll casting with a twin roll caster, molten metal is introduced between a pair of counter rotated casting rolls that are cooled. Solidified metal shells are formed on the moving casting surfaces and are brought together at a nip between the casting rolls to produce thin cast strip delivered downwardly from the nip. The term "nip" is used herein to refer to the general region in which the casting rolls are closest together. In any case, the molten metal is usually poured from a ladle into a smaller vessel, and from there, flows through a metal delivery system to distributive nozzles located generally above the nip between the casting rolls. During casting, the molten metal is delivered between the casting rolls to form a casting pool of molten metal supported on the casting surfaces of the rolls adjacent the nip and along the length of the casting rolls. Such casting pool is usually confined between side plates or dams, which are held in sliding engagement adjacent the ends of the casting rolls, so as to confine the two ends of the casting pool.

When casting thin steel strip with a twin roll caster, the molten metal in the casting pool will generally be at a temperature of the order of 1500° C. and above. It is therefore necessary to achieve very high cooling rates over the casting surfaces of the casting rolls. A high heat flux and extensive nucleation on initial solidification of the metal shells on the casting surfaces is needed to form the steel strip. U.S. Pat. No. 5,760,336, incorporated herein by reference, describes how the heat flux on initial solidification can be increased by adjusting the steel melt chemistry such that a substantial portion of the metal oxides formed are liquid at the initial solidification temperature, and in turn, a substantially liquid layer is formed at the interface between the molten metal and casting surfaces. As disclosed in U.S. Pat. Nos. 5,934,359 and 6,059,014 and International Application AU 99/00641, the disclosures of which are incorporated herein by reference, nucleation of the steel on initial solidification can be influenced by the texture of the casting surface. In particular, International Application AU 99/00641 discloses that a random texture of discrete protrusions formed in the casting surfaces can enhance initial solidification by providing substantial nucleation sites distributed over the casting surfaces.

Attention has been given in the past to the steel chemistry of the melt, particularly in the ladle metallurgy furnace before thin strip casting. We have given attention in the past to the oxide inclusions and the oxygen levels in the steel metal, and their impact on the quality of the steel strip produced. We have also found that the quality of the steel strip and the production of the thin steel strip is also enhanced by control of the hydrogen levels and nitrogen levels in the molten steel. Controlling hydrogen and nitrogen levels has in the past been the subject of investigation in slab casting, but to our knowledge has not been a focus of attention in thin strip casting until our work. For example, see *Control of Heat Removal in the Continuous Casting Mould*, by P. Zasowski and D. Sosinsky, 1990 Steelmaking Conference Proceedings, 253-259; and *Determination and Prediction of Water Vapor Solubilities in CaO—MgO—SiO2 Slags*, by D. Sosinsky, M. Maeda and A. Mclean, Metallurgical Transactions, vol. 16b, 61-66 (March 1985).

We have also described in parent U.S. patent application Ser. No. 10/961,300, filed Oct. 8, 2004, and U.S. provisional patent application 60/510,479, filed Oct. 10, 2003, that controlling the hydrogen level to below about 6.9 ppm and the nitrogen level to below about 120 ppm, while maintaining the sum of the partial pressures of hydrogen and nitrogen to not more than 1.15 atmospheres is a substantial advance in thin strip casting. We described that by controlling the hydrogen and nitrogen levels in plain carbon steel strip unique composition and production qualities can be produced by roll casting.

Now, we have found that the amount of heat flux from the metal shells is sensitive to the nitrogen levels in the molten steel in the casting pool, and therefore, by controlling the nitrogen levels in the casting pool the heat flux between the molten metal and the casting rolls can be controlled. Disclosed is a method of casting steel strip comprising the steps of:

- determining a desired heat flux set point in casting thin cast strip from molten metal from a casting pool between casting rolls in a twin roll caster;
- calculating the heat flux during casting of thin steel strip from molten metal in the casting pool in the twin roll caster; and
- changing the nitrogen concentration in the casting pool to adjust the heat flux to the desired heat flux set point.

The nitrogen concentration in the casting pool may be controlled during the casting campaign to adjust for changes roughness of the casting rolls and other operating conditions to maintain the calculated heat flux to the desired heat flux set point or some adjustment therefrom as desired. The controlling step may be done manually by an operator or done automatically by a proportional controller.

Also disclosed is a method of casting thin steel strip comprising the steps of:

- introducing molten plain carbon steel on casting surfaces of at least one casting roll with the molten steel having a nitrogen content below about 120 ppm and a hydrogen content below about 6.9 ppm and such that the sum of partial pressure of nitrogen and partial pressure of hydrogen is no more than 1.15 atmospheres;
- forming a casting pool of molten metal on the casting surfaces of the casting roll;
- causing the nitrogen level in the molten metal in the casting pool to vary depending on casting speed and strip thickness to control heat flux between the casting pool and the surfaces of the casting roll to a desired value; and
- solidifying the molten steel to form metal shells on the casting rolls having nitrogen and hydrogen levels reflected by the content thereof in the molten steel to form thin steel strip.

The method of casting steel strip nay be carried out by the steps comprising the following:

- assembling a pair of cooled casting rolls having a nip between them and confining end closures adjacent to ends of the casting rolls;
- introducing molten plain carbon steel between the pair of casting rolls to form a casting pool on the casting rolls with the end closures confining the pool, with the molten steel having a nitrogen content below about 120 ppm and a hydrogen content below about 6.9 ppm and such that the sum of partial pressure of nitrogen and partial pressure of hydrogen is no more than 1.15 atmospheres;

causing the nitrogen level in the molten metal in the casting pool to be varied depending on casting speed and strip thickness to control heat flux between the casting pool and the surfaces of the casting roll to a desired value;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

In any of these methods, nitrogen level in the molten melt in the casting pool may be controlled by introducing the nitrogen in the metal delivery system, e.g. in the tundish, above the casting pool. In any of these methods, the nitrogen levels in the casting pool may be maintained below 100 ppm or 85 ppm. In any of these methods, the hydrogen content may be between 1.0 and 6.5 ppm.

In any of these methods, the heat flux can be indirectly correlated with the sum of the calculated partial pressures of nitrogen and hydrogen in the casting pool. The sum of the partial pressures of nitrogen and hydrogen calculated from the concentrations of nitrogen and hydrogen in the molten metal of the casting pool may be no more than 1.15 atmospheres, or may be between 0.1 and 0.8 atmospheres. Note that the partial pressures of nitrogen and of hydrogen are calculated from the levels, or concentrations, of nitrogen and hydrogen in the casting pool. See Richard J. Fruehan, ed., *The Making, Shaping and Treating of Steel* § 2.4.2.1 Table 2.9 ($11^{th}$ ed. 1998). As a practical matter, the nitrogen and hydrogen concentrations are typically measured in the tundish adjacent the casting pool, and it is the measured levels of nitrogen and hydrogen in the tundish that are reported herein. There is typically a slight nitrogen pick up of the molten metal between the tundish and the casting pool; however, the concentrations of the nitrogen and hydrogen in the casting pool are believed to be the concentrations related to control of the heat flux.

The method of casting steel strip may include the steps of correlating the heat flux with the sum of the calculated partial pressures of hydrogen and nitrogen associated the nitrogen and hydrogen concentrations in the casting pool, measuring the hydrogen and nitrogen concentrations in the molten metal going into the casting pool during casting, calculating the sum of the partial pressures associated with the measured hydrogen and nitrogen concentrations, and changing the concentration of nitrogen in the casting pool to provide the sum of the calculated partial pressures associated with the hydrogen and nitrogen concentrations correlated with the desired heat flux.

Plain carbon steel for purpose of the present invention is defined as less than 0.65% carbon, less than 2.5% silicon, less than 0.5% chromium, less than 2.0% manganese, less than 0.5% nickel, less than 0.25% molybdenum and less than 0.05% aluminum, together with of other elements such as sulfur, oxygen and phosphorus which normally occur in making carbon steel by electric arc furnace. Low carbon steel may be used in these methods having a carbon content in the range 0.001% to 0.1% by weight, a manganese content in the range 0.01% to 2.0% by weight, and a silicon content in the range 0.01% to 2.5% by weight. The steel may have an aluminum content of the order of 0.05% or less by weight. The aluminum may, for example, be as little as 0.008% or less by weight. The molten steel may be a silicon/manganese killed steel.

In these methods, the sulfur content of the steel maybe 0.01% or less. For example, the sulfur content of the steel may be 0.007% by weight.

The nitrogen and hydrogen levels are the dissolved nitrogen and hydrogen in the molten metal, and not nitrogen and hydrogen combined with other elements in compounds in the molten metal. In these methods, the nitrogen may be measured by optical emission spectrometry, calibrated against the thermal conductivity method as described below. The hydrogen levels may be determined by a Hydrogen Direct Reading Immersed System ("Hydris") unit, made by Hereaus Electronite.

The maximum allowable nitrogen and hydrogen levels in the casting pool may be associated with the sum of the calculated partial pressures of hydrogen and nitrogen and may be such as to not exceed 1.15 or 1.0 atmospheres. Higher pressures may be utilized in certain conditions, and the associated levels of nitrogen and hydrogen can be corresponding higher. For example, as explained below, a ferrostatic head may be 1.15, causing the nitrogen levels and hydrogen levels to be higher in the casting pool. But for purposes of the parameters of the present methods, the partial pressures of nitrogen and hydrogen are calculated from the measured levels of nitrogen and hydrogen in the molten metal using the equation described below. The calculated partial pressure would be the gas pressure that the nitrogen or hydrogen exerts in equilibrium with the liquid steel; the partial pressures of nitrogen and hydrogen in the casting pool are during a casting campaign usually determined by the gases injected into the chamber in which the casting pool is formed.

The present invention provides cast steel strip with unique properties that are described by the methods by which it is made. This steel strip may be described as plain carbon steel.

BRIEF DESCRIPTION OF THE DRAWINGS

In order that the invention may be more fully explained, illustrative results of experimental work carried out to date will be described with reference to the accompanying drawings in which.

DETAILED DESCRIPTION OF THE DRAWINGS

Figure 1:
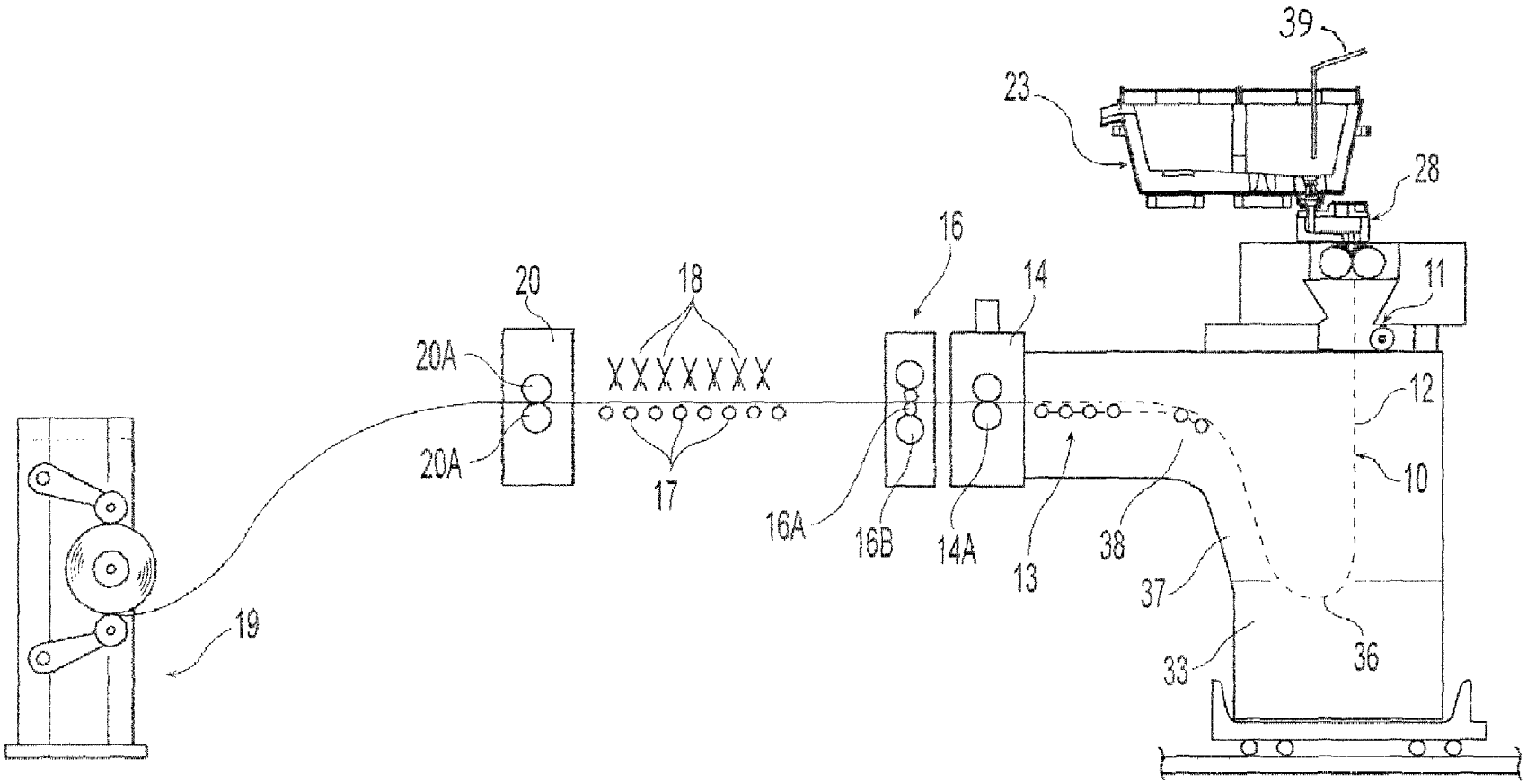
FIG. 1 is a diagrammatic side elevation view of an illustrative strip caster.
Figure 2:
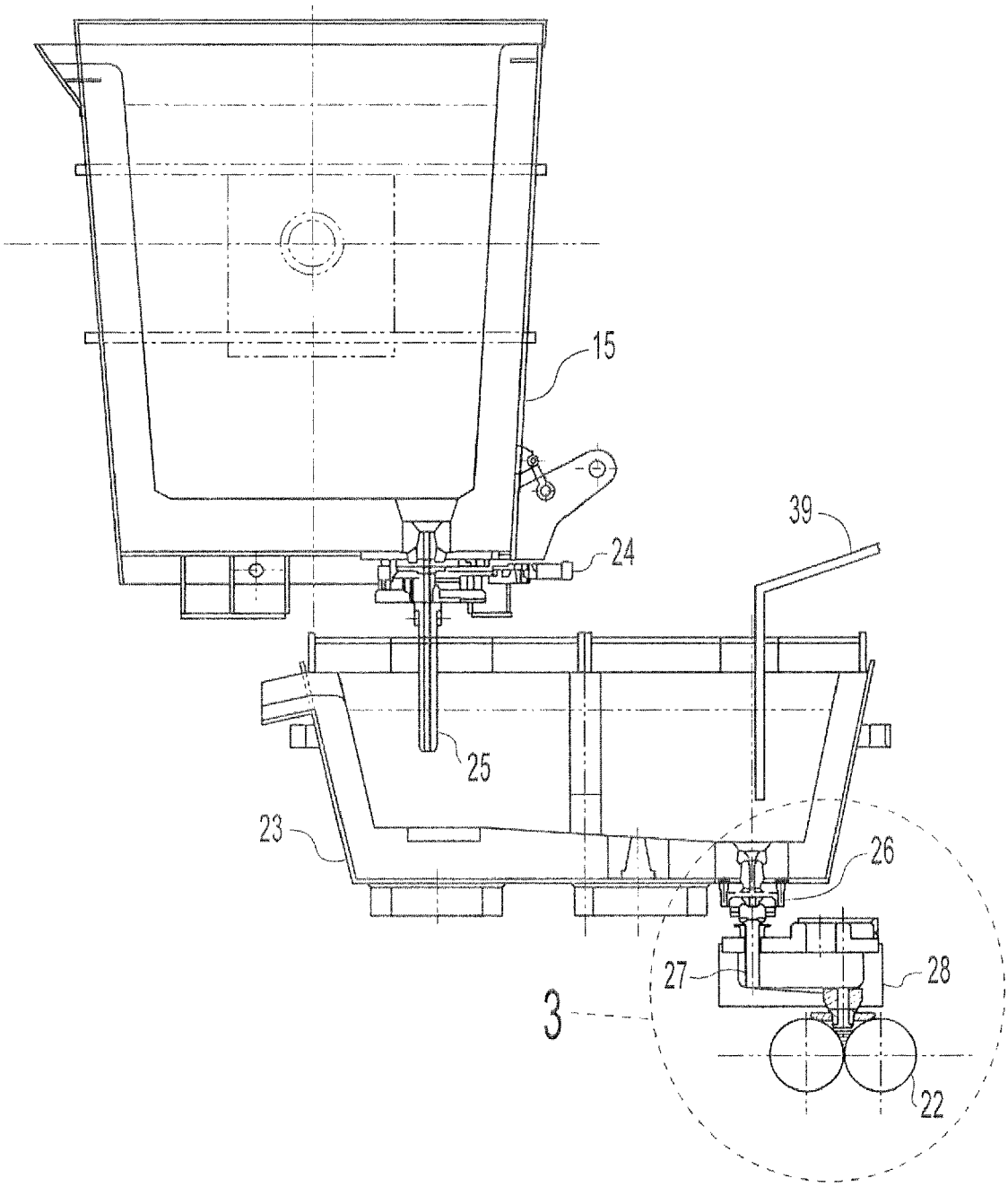
FIG. 2 is a partial side elevation of a portion of the caster of FIG. 1.
Figure 3:
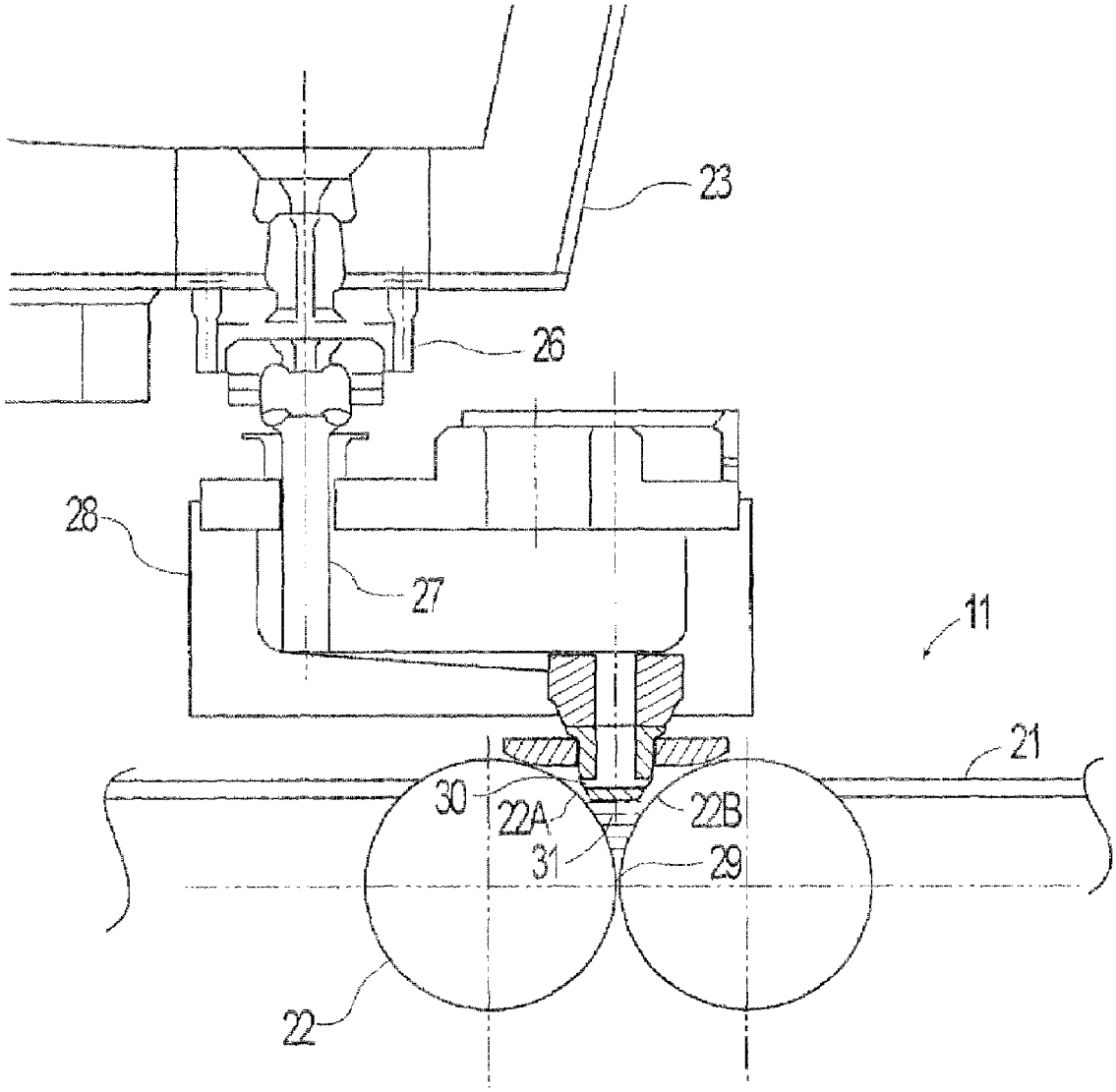
FIG. 3 is an enlarged view taken of the area marked 3 in FIG. 2.

FIGS. 1, 2 and 3 illustrate a twin roll continuous strip caster which has been operated in accordance with the present invention. The following description of the described embodiments is in the context of continuous casting steel strip using a twin roll caster. The present invention is not limited, however, to the use of twin roll casters and extends to other types of continuous strip casters.

FIG. 1 shows successive parts of an illustrative production line whereby steel strip can be produced in accordance with the present invention. FIGS. 1 and 2 illustrate a twin roll caster denoted generally as 11 which produces a cast steel strip 12 that passes in a transit path 10 across a guide table 13 to a pinch roll stand 14 comprising pinch rolls 14A. Immediately after exiting the pinch roll stand 14, the strip may pass into a hot rolling mill 16 comprising a pair of reduction rolls 16A and backing rolls 16B, where the strip is hot rolled to reduce to a desired thickness. The rolled strip passes onto a run-out table 17 on which it may be cooled by contact with water supplied via water jets 18 (or other suitable means) and by convection and radiation. In any event, the rolled strip may then pass through a pinch roll stand 20 comprising a pair of pinch rolls 20A and thence to a coiler 19.

As shown in FIGS. 2 and 3, twin roll caster 11 comprises a main machine frame 21 which supports a pair of cooled casting rolls 22 having casting surfaces 22A, 22B, assembled side-by-side with a nip between them. Molten metal of plain carbon steel may be supplied during a casting operation by gravity from a ladle 15 to a tundish 23, through a slide gate 24 and refractory shroud 25. From tundish 23, the molten metal is supplied by gravity through slide gate 26 and shroud 27 to a distributor 28, and thence through a metal delivery nozzle 30 above the nip 29 between the casting rolls 22. The molten metal thus delivered to the nip 29 forms a casting pool 31 supported on the casting roll surfaces 22A and 22B. The upper surface of casting pool 31 (generally referred to as the "meniscus" level) may rise above the lower end of the delivery nozzle 30 so that the lower end of the delivery nozzle is immersed within the casting pool 31.

Casting pool 31 is confined at the ends of the casting rolls 22 by a pair of side closure plates (not shown), which are adjacent to and held against stepped ends of the casting rolls when the roll carriage is at the casting station. Side closure plates are illustratively made of a strong refractory material, for example boron nitride composite, and have scalloped side edges to match the curvature of the stepped ends of the rolls. The side plates can be mounted in plate holders which are movable at the casting station by actuation of a pair of hydraulic cylinder units (or other suitable means) to bring the side plates into engagement with the stepped ends of the casting rolls to form end closures for the molten pool of metal formed on the casting rolls during a casting operation.

Frame 21 supports a casting roll carriage (not shown) which is horizontally movable between a mounting station and a casting station. The casting roll carriage supports the casting rolls 22, and is able to move the casting rolls 22 as an assembly from a mounting station to the casting station in the caster.

Casting rolls 22 are internally water cooled so that metal shells solidify on the moving casting surfaces 22A and 22B of the casting rolls 22 in the casting pool 31. The shells are then brought together at the nip 29 between the casting rolls to produce the solidified strip 12, which is delivered downwardly from the nip.

Casting rolls 22 are counter-rotated through drive shafts (not shown) driven by an electric, hydraulic or pneumatic motor and transmission. Each casting roll 22 may have copper peripheral walls adjacent the casting surfaces 22A and 22B. coated with chromium, or nickel or some other suitable hard coating. Formed in each casting roll 22 is a series of longitudinally extending and circumferentially spaced water cooling passages to supply cooling water. The casting rolls 22 may typically be about 500 mm in diameter, and may be up to 1200 mm or more in diameter. The casting rolls 22 may be up to about 2000 mm, or longer, in order to produce strip product of about 2000 mm wide, or wider.

Tundish 23 is of conventional construction. It is formed as a wide dish made of a refractory material such as for example magnesium oxide (MgO). One side of the tundish receives molten metal from the ladle, and an overflow spout and an emergency plug (not shown) may be provided at the other side if desired.

Delivery nozzle 30 is formed as an elongated body made of a refractory material such as for example alumina graphite or zirconia graphite. Its lower part is tapered so as to converge inwardly and downwardly above the nip between casting rolls 22, and to be submerged in the casting pool 31. Delivery nozzle 30 may have a series of horizontally spaced, generally vertically extending flow passages to produce a suitably low horizontal discharge of molten metal along the width of the casting rolls and to deliver the molten metal in the casting pool 31 onto the roll surfaces 22A and 22B where solidification occurs. The delivery nozzle may be a described in more detail in U.S. Pat. No. 6,012,508, which is incorporated here in by reference.

The twin roll caster may be of the kind illustrated and described in some detail in, for example, U.S. Pat. Nos. 5,184,668; 5,277,243; 5,488,988; and/or 5,934,359; U.S. patent application Ser. No. 10/436,336; and International Patent Application PCT/AU93/00593, the disclosures of which are incorporated herein by reference. Reference may be made to those patents for appropriate construction details but forms no part of the present invention.

Figure 4:
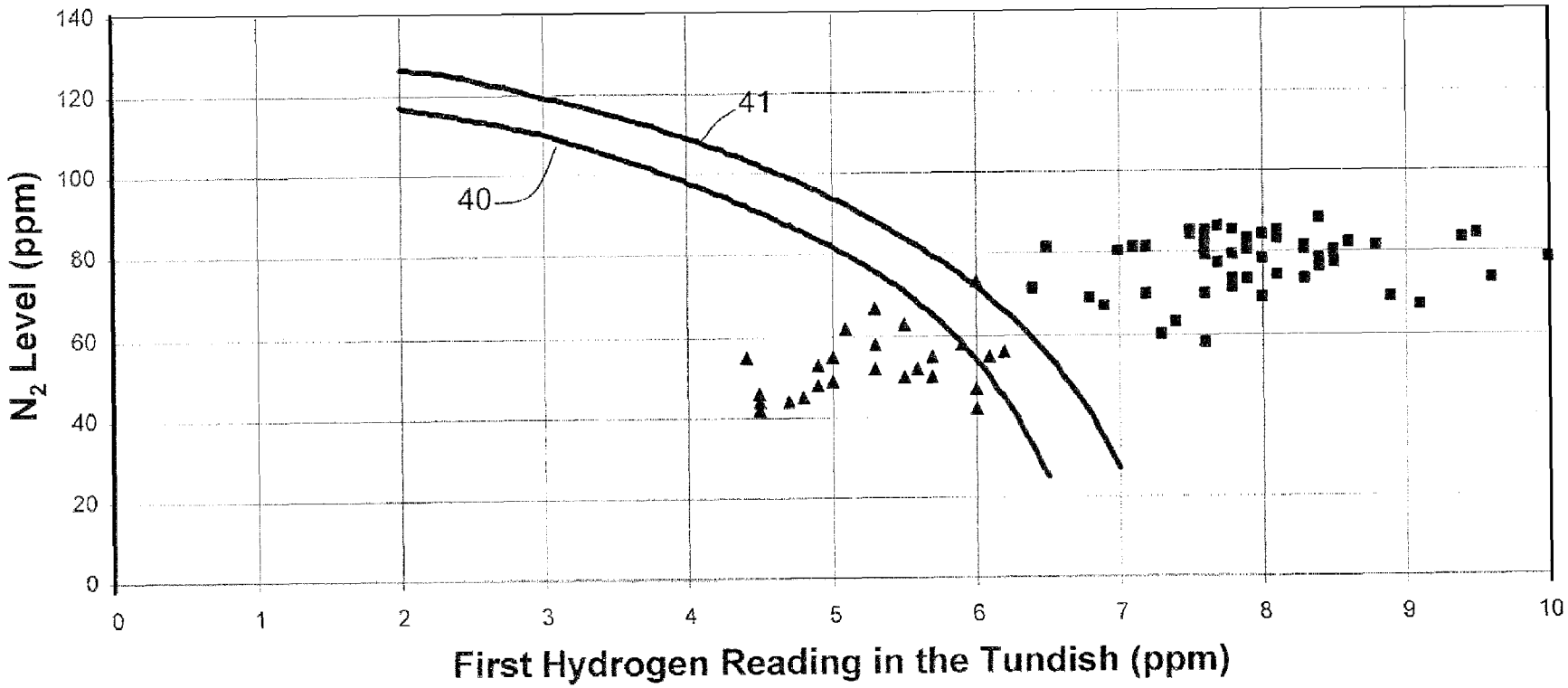
FIG. 4 is a graph showing allowable nitrogen levels and hydrogen levels in low carbon steel for a cast steel strip.

Results of the control of the nitrogen and hydrogen levels, or concentrations, in the casting pool 31 in making thin cast sheets of plain carbon steel are set forth in FIG. 4. As FIG. 4 shows, where the nitrogen level was below about 85 ppm and the hydrogen level was below about 6.5 ppm, the thin cast strip produced corresponded to premium "cold-rolled" steel quality. These data points are identified with triangular notation in FIG. 4. The heat(s) where the nitrogen level was between about 60 and 90 ppm and the hydrogen level was above about 6.9 ppm, did not produce suitable thin cast strip of the present invention. These data points are identified with rectangular notation in FIG. 4. We have found, however, that the nitrogen level can be higher up to 100 ppm or 120 ppm, provided the hydrogen level is maintained below 6.9 ppm and sum of the partial pressure of nitrogen and hydrogen is no more than 1.15 atmospheres. Similar data are set forth in Tables 1 and 2, and FIG. 3, of U.S. patent application Ser. No. 10/961,300 filed Oct. 8, 2004, which is incorporated by reference. Note that these measurements of nitrogen and hydrogen were made at tundish 23 above the casting pool 31, and there is a slight nitrogen pickup to be expected between the tundish and the casting pool. Note that the hydrogen concentrations were the first measurements taken in the tundish for each ladle of molten steel.

Specifically, referring to FIG. 4, graph line 40 represents the concentrations of nitrogen and hydrogen such that the sum of the calculated partial pressure of hydrogen and the calculated partial pressure of nitrogen is equal to 1.0 atmosphere. Graph line 41 represents the concentrations of nitrogen and hydrogen such that the sum of the calculated partial pressures of hydrogen and nitrogen is equal to 1.15 atmospheres. Heats falling below graph line 41 in FIG. 4 made high quality steel strip. Thus, in one casting process, an operational heat flux was maintained when the concentration of nitrogen was maintained below graph line 41. In an alternate casting process, an operational heat flux was maintained when the concentration of nitrogen was maintained below graph line 40.

The heat flux data reported in FIG. 4, as well as other data reported in this application, is developed by measuring the energy removed through the casting rolls 20 by the cooling water, and normalizing the megawatts extracted to megawatts per square meter knowing the surface area of the casting surfaces 22A and 22B in contact with the casting pool 31.

Figure 6:
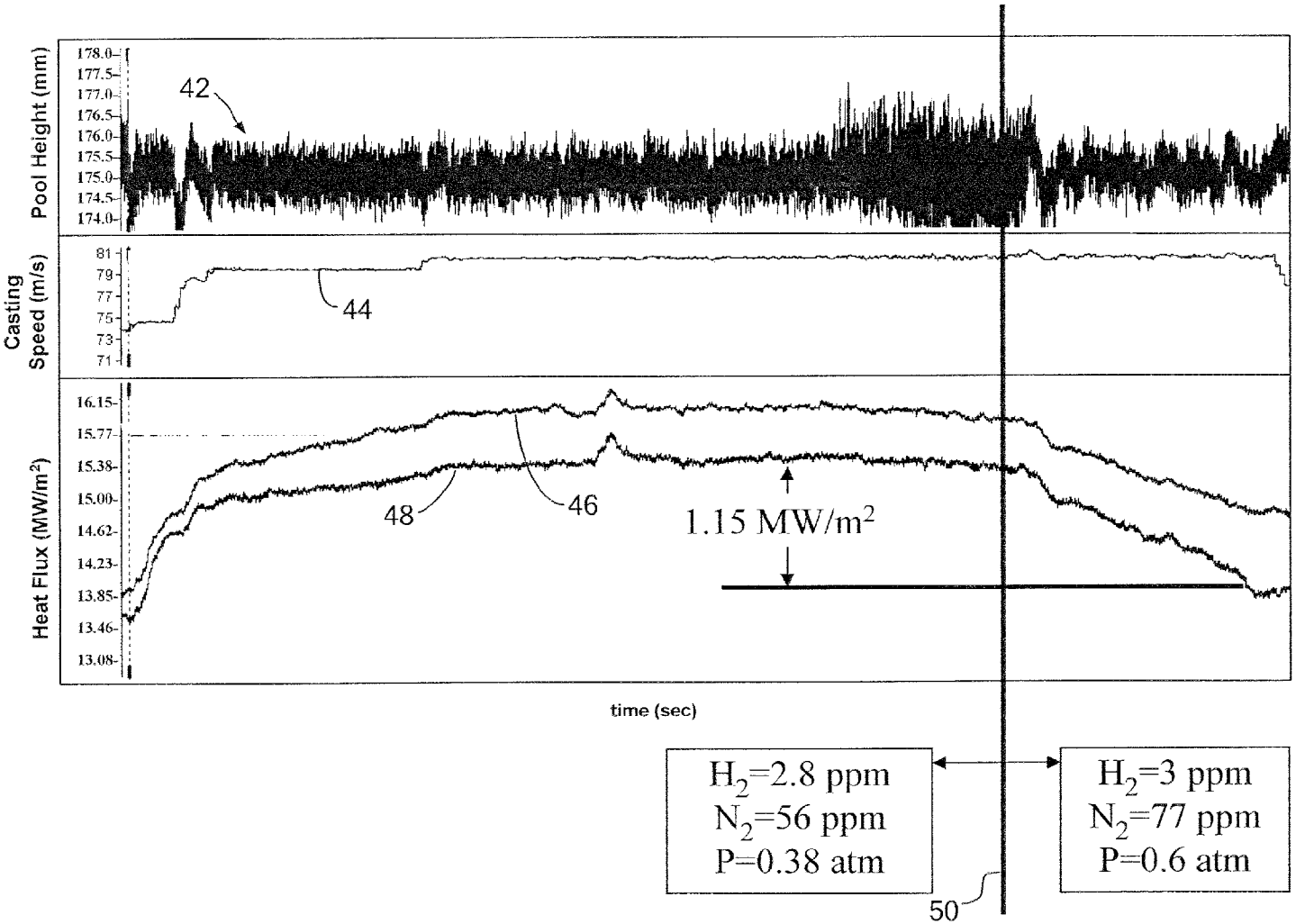
FIG. 6 is concurrently measured data of heat flux, casting speed and pool height with time taken from a casting campaign, showing the incremental change in heat flux with change in nitrogen concentration in the casting pool.

Moreover, we have found as disclosed herein that there is a correlation between the concentration of nitrogen in the steel melt and the amount of heat flux from the molten metal in the casting pool to the casting rolls. As illustrated in FIG. 6, when the concentration of nitrogen in the casting pool was increased, the heat flux from the molten steel in the casting pool to the casting rolls decreased. Thus, when nitrogen levels are decreased and heat flux to a casting roll correspondingly increased, casting speed may be increased or strip thickness may be increased, or both. Conversely, when nitrogen levels are increased and heat flux to a casting roll correspondingly decreased, casting speed may be reduced and/or strip thickness may be reduced.

As demonstrated in FIG. 6, direct control of heat flux is thus provided by controlling the level of nitrogen in the casting pool. FIG. 6 is a casting process chart showing the heat flux 46 and 48 (in megawatts per square meter) from the casting pool to the casting roll in forming solidified metal shells on the casting surfaces of entry side and exit side casting rolls 22. As shown by FIG. 6, when the nitrogen level in the casting pool 31 was increased from 56 ppm to 77 ppm, the heat flux dropped almost immediately by 1.15 megawatts per square meter. As noted above, these reported nitrogen concentrations were made by measurements in the tundish 23, above the casting pool 31, and there is a slight nitrogen pick up to be expected between the tundish and the casting pool. FIG. 6 also includes corresponding graphs in real time of pool height 42 (in millimeters) and casting speed 44 (in meters per minute) during the campaign. These data show the change in heat flux is caused by the change in nitrogen levels in the casting pool 31, and not by any change in pool height or in casting speed.

Specifically, in the casting process measured in FIG. 6, the concentration of nitrogen was increased from 56 to 77 ppm at the time marked by a line 50, while maintaining the pool height 42 and the casting speed 44 substantially the same. During this increase in nitrogen level, the amount of heat flux 46 and 48 from the molten steel decreased by approximately 1.15 megawatts per square meter at the casting surfaces 22A and 22B of the casting rolls 22. This illustrates that presently disclosed method provides a sensitive direct control of the heat flux between the casting pool 31 and the casting rolls 22 by controlling the nitrogen concentration in the casting pool.

Cast steel strip is produced using the casting method by introducing molten plain carbon steel on casting surfaces 22A and 22B of casting rolls 22, with the molten steel having a nitrogen concentration below about 120 ppm and a hydrogen concentration below about 6.9 ppm, and such that the sum of partial pressure of nitrogen and partial pressure of hydrogen is no more than 1.15 atmospheres, forming a casting pool of molten metal on the casting surfaces of the casting rolls, causing the nitrogen concentration in the molten metal in the casting pool to be varied depending on casting speed and strip thickness to control heat flux between the casting pool and the casting roll to a desired value, and solidifying the molten steel to form metal shells on the casting rolls having nitrogen and hydrogen concentrations reflected by the content thereof in the molten steel to form thin steel strip.

It is contemplated that a desired heat flux and nitrogen concentration in the casting pool can be maintained and controlled by monitoring and controlling the concentration of nitrogen entering the casting pool, e.g., in tundish 23. Prior to casting, the molten steel may be treated by a vacuum degassing that reduces the amounts of nitrogen and hydrogen in the steel melt. However, thereafter, a desired nitrogen concentration in the molten metal in the casting pool may be maintained by monitoring and changing a controlled amount of nitrogen. One method of changing nitrogen concentration in the molten metal of the casting pool is by introducing nitrogen gas into the tundish 23 through a lance 39, as shown on FIG. 2.

Figure 5:
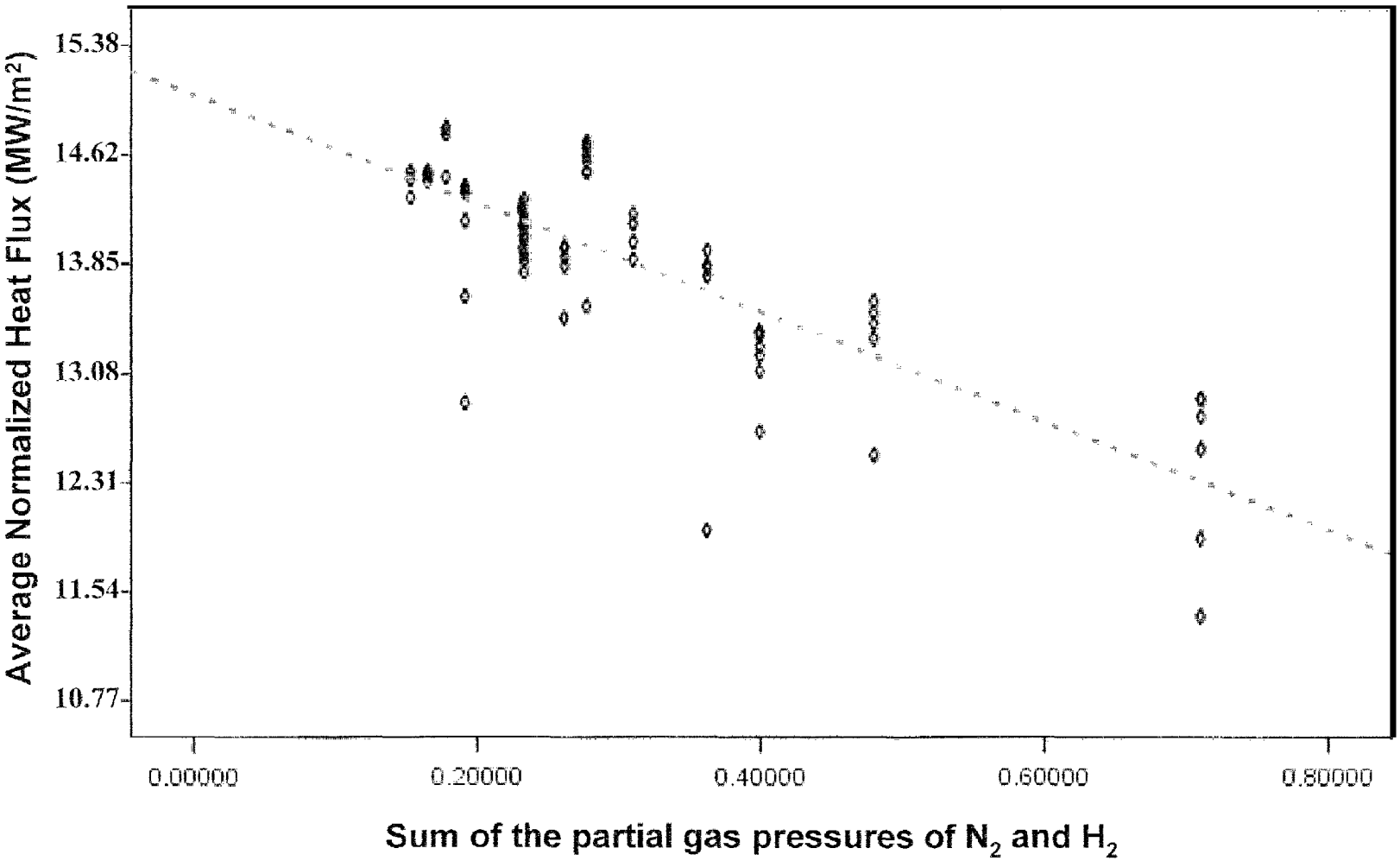
FIG. 5 is a graph showing the relationship between heat flux and the sum of the partial pressures of nitrogen and hydrogen levels in making low carbon steel by twin roll caster in the embodiment of the present invention.

The graph of FIG. 5 shows the relationship between heat flux with different values for the sum of the partial pressures of nitrogen and of hydrogen. Specifically, the vertical axis of FIG. 5 is an average of the heat flux (in megawatts per square meter) of the entry side and delivery side casting rolls. The horizontal axis of FIG. 5 is the sum of the partial pressures of nitrogen and hydrogen calculated from the measured concentrations of nitrogen and hydrogen in or above the casting pool, e.g. in tundish 23. The partial pressures of nitrogen and hydrogen were calculated using the following well known equations:

$$\log\frac{[ppm\ \mathrm{H}]}{(p_{\mathrm{H}_2})^{1/2}} = -\frac{1900}{T} + 2.423$$

$$\log\frac{[ppm\ \mathrm{N}]}{(p_{\mathrm{N}_2})^{1/2}} = -\frac{188}{T} + 2.760$$

Where H and N are hydrogen and nitrogen concentrations in ppm, $p_H$ and $p_N$ are partial pressures of hydrogen and nitrogen in atmospheres, and T is temperature in ° K. See, Richard J. Fruehan, ed., *The Making, Shaping and Treating of Steel* § 2.4.2.1 Table 2.9 ($11^{th}$ ed. 1998). Also shown in FIG. 5 is a linear regression fit to the data.

This FIG. 5 demonstrates heat flux from the casting pool to the casting roll can be determined by calculating the sum of the partial pressures of hydrogen and nitrogen from the concentrations of nitrogen and hydrogen in the casting pool 31. As noted above, these concentrations are actually measured in the tundish 23, where it is practical to do the measurement, and there is a slight pick up of nitrogen to be expected between the tundish and the casting pool. Nevertheless, it is the partial pressures of nitrogen and hydrogen in the casting pool that is desired. The heat flux is directly controlled by adjusting the concentrations of nitrogen and hydrogen to the concentrations from which the sum of the partial pressures of nitrogen and hydrogen are calculated as described above.

This FIG. 5 is with casting rolls 20 early in their operating life where the surface roughness of the casting roll surfaces 22A and 22B are about 10 Ra. As noted by comparison of FIG. 5 with FIG. 6, the heat flux increases with wear on the casting surfaces 22A and 22B of the casting rolls. The roughness of the casting surfaces 22A and 22B at the time of the heat flux reported in FIG. 6 is believed to have been about 7 Ra. This change in heat flux with the change in roughness of the casting roll surfaces 22A and 22B may be adjusted for by a proportional controller providing for change in the nitrogen concentration, either manually or automatically, to maintain the desired heat flux set point with change in roughness on the casting roll surfaces and other operating conditions.

Accordingly, one method for controlling the concentration of nitrogen in the molten steel includes the steps of measuring the concentrations of nitrogen and hydrogen in the molten steel, calculating the sum of the partial pressure of nitrogen and the partial pressure of hydrogen from the measured concentrations of nitrogen and hydrogen in the molten steel, calculating the amount of nitrogen that needs to be changed to make the sum of nitrogen and hydrogen partial pressures equal a predetermined value for achieving a desired heat flux, and changing the concentration of nitrogen in the casting pool to achieve the nitrogen concentration related to a targeted sum of the calculated partial pressure of nitrogen and hydrogen. The sums of the calculated pressures of nitrogen and hydrogen is no more than 1.15 atmospheres, and if desired to reach a correlated set point heat flux, between 0.1 and 0.8 atmospheres as shown in FIG. 5.

Cast steel strip is produced in one casting method by introducing molten plain carbon steel on casting surfaces of at least one casting roll, with the molten steel having a nitrogen concentration below about 120 ppm and a hydrogen concentration below about 6.9 ppm, and such that the sum of partial pressure of nitrogen and partial pressure of hydrogen is no more than 1.15 atmospheres, forming a casting pool of molten metal on the casting surfaces of the casting roll, varying the nitrogen concentration in the molten metal in the casting pool depending on casting speed and strip thickness to control heat flux between the casting pool and the surfaces of the casting roll to a desired value, and solidifying the molten steel to form metal shells on the casting rolls having nitrogen and hydrogen concentrations reflected by the content thereof in the molten steel to form this steel strip.

A desired heat flux may be maintained when the sum of the partial pressure of nitrogen and the partial pressure of hydrogen in the melt is no more than 1.15 atmosphere, indicated by the graph line 41 in FIG. 4, or the sum of the partial pressure of nitrogen and the partial pressure of hydrogen in the melt is no more than 1.0 atmosphere, indicated by the graph line 40 in FIG. 4. A desired heat flux set point may be provided and maintained by relating the heat flux set point with a corresponding sum of the partial pressures of nitrogen and hydrogen in the casting pool between 0.1 and 0.8 atmospheres.

In casting method, the concentration of hydrogen in the steel melt is less than about 6.9 ppm. The concentration of hydrogen may be between 1.0 and 6.5 ppm. It is contemplated that the concentration of nitrogen will be below about 120 ppm. The concentration of nitrogen may be below about 100 ppm or below about 85 ppm.

The nitrogen was determined by analysis with optical emission spectrometry ("OES") calibrated against the thermal conductivity ("TC") method on a scheduled basis. Optical emission spectrometry (OES) using arc and spark excitation is the preferred method to determine the chemical composition of metallic samples. This process is widely used in the metal making industries, including primary producers, foundries, die casters and manufacturing. Due to its rapid analysis time and inherent accuracy, Arc/Spark OES systems are most effective in controlling the processing of alloys. These spectrometers may be used for many aspects of the production cycle including in-coming inspection of materials, metal processing, quality control of semi-finished and finished goods, and many other applications where a chemical composition of the metallic material is required.

The Thermal Conductivity (TC) method, used to calibrate the OES, typically employs a microprocessor-based, software controlled instrument that can measure nitrogen, as well as oxygen, in a wide variety of metals, refractories and other inorganic materials. The TC method employs the inert gas fusion principle. A weighed sample, placed in a high purity graphite crucible, is fused under a flowing helium gas stream at temperatures sufficient to release oxygen, nitrogen and hydrogen. The oxygen in the sample, in all forms present, combines with the carbon from the crucible to form carbon monoxide. The nitrogen present in the sample releases as molecular nitrogen and any hydrogen is released as hydrogen gas.

In the TC method, oxygen is measured by infrared absorption (IR). Sample gases first enter the IR module and pass through CO and $CO_2$ detectors. Oxygen present as either CO or $CO_2$ is detected. Following this, sample gas is passed through heated rare-earth copper oxide to convert CO to $CO_2$ and any hydrogen to water. Gases then re-enter the IR module and pass through a separate $CO_2$ detector for total oxygen measurement. This configuration maximizes performance and accuracy for both low and high range.

In the TC method, nitrogen is measured by passing sample gases to be measured through heated rare-earth copper oxide which converts CO to $CO_2$ and hydrogen to water. $CO_2$ and water are then removed to prevent detection by the TC cell. Gas flow then passes through the TC cell for nitrogen detection.

As stated above, the hydrogen is measured by a Hydrogen Direct Reading Immersed System ("Hydris") unit, made by Hereaus Electronite. This unit is believed to be described in the following referenced US patents: U.S. Pat. Nos. 4,998,432; 5,518,931 and 5,820,745.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

What is claimed is:

1. A method of casting steel strip comprising:

introducing molten plain carbon steel on casting surfaces of at least one casting roll with the molten steel having a nitrogen content below about 120 ppm and a hydrogen content below about 6.9 ppm and such that the sum of partial pressure of nitrogen and partial pressure of hydrogen is no more than 1.15 atmospheres;

forming a casting pool of molten metal adjacent the casting surfaces of the casting roll;

causing the nitrogen level in the molten metal in the casting pool to vary depending on casting speed and strip thickness to control heat flux between the casting pool and the surfaces of the casting roll to a desired value; and solidifying the molten steel to form metal shells on the casting rolls having nitrogen and hydrogen levels reflected by the content thereof in the molten steel to form thin steel strip.

2. The method of claim 1 where the sum of partial pressure of nitrogen and partial pressure of hydrogen calculated from the nitrogen and hydrogen concentration in the introduced molten metal is no more than 1.0 atmosphere.

3. The method of casting steel strip of claim 2 where the sum of the partial pressures of hydrogen and nitrogen is between 0.2 and 0.8 atmospheres.

4. The method of casting steel strip of claim 1 comprises the steps of correlating heat flux with the sum of the partial pressures of hydrogen and nitrogen in the casting pool, measuring the hydrogen and nitrogen concentrates in the molten metal going into the casting pool, calculating die sum of the partial pressures from the measured hydrogen and nitrogen concentration, and changing the concentration of nitrogen in the casting pool to provide the sum of the partial pressure of the hydrogen and nitrogen to provide the desired correlated heat flux.

5. The method of casting steel strip of claim 1 where the hydrogen content is between 1.0 and 6.5 ppm.

6. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a nitrogen content below about 120 ppm and a hydrogen content below about 6.9 ppm and such that the sum of partial pressure of nitrogen and partial pressure of hydrogen is no more than 1.15 atmospheres;

causing the nitrogen level in the molten metal in the casting pool to vary depending on casting speed and strip thickness to control heat flux between the casting pool and the surfaces of the casting roll to a desired value;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

7. The method of casting steel strip of claim 6 where the nitrogen level in the molten metal in the casting pool is controlled by calculating the sum of the partial pressures of nitrogen and hydrogen from the measured concentration of hydrogen and nitrogen in the casting pool, correlating the sum of the partial pressures of hydrogen and nitrogen with a desired level of heat flux, and adding or reducing nitrogen levels in the achieved desired sum of the partial pressures associated with target heat flux.

8. The method of claim 6 where the sum of partial pressure of nitrogen and partial pressure of hydrogen is no more than 1.0 atmosphere.

9. The method of casting steel strip of claim 6 where the sum of the partial pressures of hydrogen and nitrogen is between 0.2 and 0.8 atmospheres.

10. The method of casting steel strip of claim 9 comprises the steps of correlating heat flux with the sum of the partial pressures of hydrogen and nitrogen in the casting pool, measuring the hydrogen and nitrogen concentrates in the molten metal going into the casting pool, calculating the sum of the partial pressures from the measured hydrogen and nitrogen concentration, and changing the concentration of nitrogen in the casting pool to provide the sum of the partial pressure of the hydrogen and nitrogen to provide the desired correlated heat flux.

11. The method of claim 6 where the hydrogen content is between 1.0 and 6.5 ppm.

12. A method of casting steel strip comprising:

introducing molten plain carbon steel on casting surfaces of at least one casting roll with the molten steel having a nitrogen content below about 100 ppm and a hydrogen content below about 6.9 ppm and such that the sum of partial pressure of nitrogen and partial pressure of hydrogen is no more than 1.15 atmospheres;

forming a casting pool of molten metal adjacent the casting surfaces of the casting roll;

causing the nitrogen level in the molten metal in the casting pool to vary depending on casting speed and strip thickness to control heat flux between the casting pool and the surfaces of the casting roll to a desired value; and solidifying the molten steel to form metal shells on the casting rolls having nitrogen and hydrogen levels reflected by the content thereof in the molten steel to form thin steel strip.

13. The method of claim 12 where the sum of partial pressure of nitrogen and partial pressure of hydrogen calculated from the nitrogen and hydrogen concentration in the introduced molten metal is no more than 1.0 atmosphere.

14. The method of casting steel strip of claim 12 where the sum of the partial pressures of hydrogen and nitrogen is between 0.2 and 0.8 atmospheres.

15. The method of casting steel strip of claim 14 comprises the steps of correlating heat flux with the sum of the partial pressures of hydrogen and nitrogen in the casting pool, measuring the hydrogen and nitrogen concentrates in the molten metal going into the casting pool, calculating the sum of the partial pressures from the measured hydrogen and nitrogen concentration, and changing the concentration of nitrogen in the casting pool to provide the sum of the partial pressure of the hydrogen and nitrogen to provide the desired correlated heat flux.

16. The method of casting steel strip of claim 12 where heat flux is correlated with the sum of the partial pressures of hydrogen and nitrogen in the casting pool, the hydrogen and nitrogen concentrates in the molten metal going into the casting pool in is measured and the sum of the partial pressures is calculated, and the concentration of nitrogen in the casting pool is changed to provide the sum of the partial pressure of the hydrogen and nitrogen to provide the desired correlated heat flux.

17. The method of casting steel strip of claim 12 where the hydrogen content is between 1.0 and 6.5 ppm.

18. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a nitrogen concentration below about 100 ppm and a hydrogen concentration below about 6.9 ppm and such that the sum of partial pressure of nitrogen and partial pressure of hydrogen is no more than 1.15 atmospheres;

causing the nitrogen level in the molten metal in the casting pool to vary depending on casting speed and strip thickness to control heat flux between the casting pool and the surfaces of the casting roll to a desired value;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

19. The method of casting steel strip of claim 18 where the nitrogen level in the molten metal in the casting pool is controlled by calculating the sum of the partial pressures of nitrogen and hydrogen from the concentrations of hydrogen and nitrogen in the casting pool, correlating the sum of the partial pressures of hydrogen and nitrogen with a desired level of heat flux, and adding or reducing nitrogen levels in the achieved desired sum of the partial pressures associated with target heat flux.

20. The method of claim 18 where the sum of partial pressure of nitrogen and partial pressure of hydrogen is no more than 1 atmosphere.

21. The method of casting steel strip of claim 18 where the sum of the partial pressures of hydrogen and nitrogen is between 0.2 and 0.8 atmospheres.

22. The method of casting steel strip of claim 21 comprises the steps of correlating heat flux with the sum of the partial pressures of hydrogen and nitrogen in the casting pool, measuring the hydrogen and nitrogen concentrates in the molten metal going into the casting pool, calculating the sum of the partial pressures from the measured hydrogen and nitrogen concentration, and changing the concentration of nitrogen in the casting pool to provide the sum of the partial pressure of the hydrogen and nitrogen to provide the desired correlated heat flux.

23. The method of casting steel strip of claim 18 where heat flux is correlated with the sum of the partial pressures of hydrogen and nitrogen in the casting pool, the hydrogen and nitrogen concentrates in the molten metal going into the casting pool is measured and the sum of the partial pressures is calculated, and the concentration of nitrogen in the casting pool is changed to provide the sum of the partial pressure of the hydrogen and nitrogen to provide the desired correlated heat flux.

24. The method of claim 18 where the hydrogen content is between 1.0 and 6.5 ppm.

25. A method of casting steel strip comprising:

introducing molten plain carbon steel on casting surfaces of at least one casting roll with the molten steel having a nitrogen content below about 85 ppm and a hydrogen content below about 6.9 ppm and such that the sum of partial pressure of nitrogen and partial pressure of hydrogen is no more than 1.15 atmospheres;

forming a casting pool of molten metal adjacent the casting surfaces of the casting rolls;

causing the nitrogen level in the molten metal in the casting pool to vary depending on casting speed and strip thickness to control heat flux between the casting pool and the surfaces of the casting roll to a desired value; and solidifying the molten steel to form metal shells on the casting rolls having nitrogen and hydrogen levels reflected by the content thereof in the molten steel to form thin steel strip.

26. The method of claim 25 where the sum of partial pressure of nitrogen and partial pressure of hydrogen calculated from the nitrogen and hydrogen concentration in the introduced molten metal is no more than 1.0 atmosphere.

27. The method of casting steel strip of claim 25 where the sum of the partial pressures of hydrogen and nitrogen is between 0.2 and 0.8 atmospheres.

28. The method of casting steel strip of claim 27 comprises the steps of correlating heat flux with the sum of the partial pressures of hydrogen and nitrogen in the casting pool, measuring the hydrogen and nitrogen concentrates in the molten metal going into the casting pool, calculating the sum of the partial pressures from the measured hydrogen and nitrogen concentration, and changing the concentration of nitrogen in the casting pool to provide the sum of the partial pressure of the hydrogen and nitrogen to provide the desired correlated heat flux.

29. The method of casting steel strip of claim 25 where the hydrogen content is between 1.0 and 6.5 ppm.

30. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a nitrogen content below about 85 ppm and a hydrogen content below about 6.9 ppm and such that the sum of partial pressure of nitrogen and partial pressure of hydrogen is no more than 1.15 atmospheres;

causing the nitrogen level in the molten metal in the casting pool to vary depending on casting speed and strip thickness to control heat flux between the casting pool and the surfaces of the casting roll to a desired value;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

31. The method of casting steel strip of claim 30 where the nitrogen level in the molten metal in the casting pool is controlled by calculating the sum of the partial pressures of nitrogen and hydrogen from the measured concentration of hydrogen and nitrogen in the casting pool, correlating the sum of the partial pressures of hydrogen and nitrogen with a desired level of heat flux, and adding or reducing nitrogen levels in the achieved desired sum of the partial pressures associated with target heat flux.

32. The method of claim 30 where the sum of partial pressure of nitrogen and partial pressure of hydrogen is no more than 1.0 atmosphere.

33. The method of casting steel strip of claim 30 where the sum of the partial pressures of hydrogen and nitrogen is between 0.2 and 0.8 atmospheres.

34. The method of casting steel strip of claim 33 comprises the steps of correlating heat flux with the sum of the partial pressures of hydrogen and nitrogen in the casting pool, measuring the hydrogen and nitrogen concentrates in the molten metal going into the casting pool, calculating the sum of the partial pressures from the measured hydrogen and nitrogen concentration, and changing the concentration of nitrogen in the casting pool to provide the sum of the partial pressure of the hydrogen and nitrogen to provide the desired correlated heat flux.

35. The method of claim 30 where the hydrogen content is between 1.0 and 6.5 ppm.

* * * * *